US011241896B2

(12) United States Patent
Yanagisawa et al.

(10) Patent No.: US 11,241,896 B2
(45) Date of Patent: Feb. 8, 2022

(54) HOUSING CASE AND TAPE RIBBON SET

(71) Applicant: SEIKO EPSON CORPORATION, Tokyo (JP)

(72) Inventors: Atsushi Yanagisawa, Matsumoto (JP); Akio Ishimoto, Shiojiri (JP); Mizuki Bizen, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/883,197

(22) Filed: May 26, 2020

(65) Prior Publication Data

US 2020/0398595 A1 Dec. 24, 2020

(30) Foreign Application Priority Data

Jun. 19, 2019 (JP) ..... JP2019-113539
Aug. 9, 2019 (JP) ..... JP2019-147217

(51) Int. Cl.

*B41J 15/04* (2006.01)
*B41J 29/13* (2006.01)
*B41J 15/02* (2006.01)
*B41J 32/00* (2006.01)

(52) U.S. Cl.

CPC ..... *B41J 15/044* (2013.01); *B41J 15/02* (2013.01); *B41J 29/13* (2013.01); *B41J 32/00* (2013.01)

(58) Field of Classification Search

None

See application file for complete search history.

(56) References Cited

U.S. PATENT DOCUMENTS 3,151,723 A * 10/1964 Wendt ..... B41J 33/02 400/207
3,948,455 A 4/1976 Schwartz
4,367,963 A * 1/1983 Daughters ..... B41J 32/00 242/347.2
5,454,650 A * 10/1995 Yamaguchi ..... B41J 3/4075 400/208
5,618,119 A * 4/1997 Misu ..... B41J 2/325 400/208
7,097,372 B1 * 8/2006 Heyse ..... B41J 32/00 400/613
2004/0056143 A1 3/2004 Nonomura

FOREIGN PATENT DOCUMENTS

CN 1469811 A 1/2004
JP H08-039878 A 2/1996
JP H09-216444 A 8/1997
JP 2002-347780 A 12/2002
JP 2015-164854 A 9/2015

* cited by examiner

*Primary Examiner* — Matthew G Marini
(74) *Attorney, Agent, or Firm* — Oliff PLC

(57) ABSTRACT

A housing case includes a tape roll housing section configured to house a tape roll of a wound tape to be fed to a tape printing device, a tape discharge side removal portion removably provided in a first wall section, the tape discharge side removal portion to be removed to form a tape discharge in the first wall section through which the tape fed from the tape roll is fed, and a cartridge housing section configured to house a ribbon cartridge having an ink ribbon, the ribbon cartridge to be mounted into the tape printing device and being configured to hold the tape fed from the tape roll.

9 Claims, 13 Drawing Sheets

HOUSING CASE AND TAPE RIBBON SET

The present application is based on, and claims priority from JP Application Serial Number 2019-113539, filed Jun. 19, 2019 and JP Application Serial Number 2019-147217, filed Aug. 9, 2019, the disclosures of which are hereby incorporated by reference herein in their entirety.

BACKGROUND

1. Technical Field

The present disclosure relates to a housing case for housing a tape roll of a wound tape to be fed to a tape printing device and a tape ribbon set.

2. Related Art

Lettering tape cartridges that house a roll of a tape with release paper that is wound to be fed to a lettering tape printing device are known, for example, as disclosed in JP-A-8-039878.

Such known lettering tape cartridges do not house an ink ribbon cassette to be mounted in a lettering tape printing device. Accordingly, users need to mount an ink ribbon cassette into a lettering tape printing device and then set a tape with a release paper that has been fed from a lettering tape cartridge to the lettering tape printing device.

SUMMARY

According to an aspect of the present disclosure, a housing case includes a tape roll housing section configured to house a tape roll of a wound tape to be fed to a tape printing device, a tape discharge side removal portion removably provided in a first wall section, the tape discharge side removal portion to be removed to form a tape discharge in the first wall section through which the tape fed from the tape roll is fed, and a cartridge housing section configured to house a ribbon cartridge having an ink ribbon, the ribbon cartridge to be mounted into the tape printing device and being configured to hold the tape fed from the tape roll.

According to another aspect of the disclosure, a tape ribbon set includes a tape roll of a wound tape to be fed to a tape printing device, a ribbon cartridge having an ink ribbon, the ribbon cartridge to be mounted into the tape printing device and being configured to hold the tape fed from the tape roll, and a housing case configured to house the tape roll and the ribbon cartridge. The housing case includes a tape roll housing section configured to house the tape roll, a tape discharge side removal portion removably provided in a first wall section, the tape discharge side removal portion to be removed to form a tape discharge in the first wall section through which the tape fed from the tape roll is fed, and a cartridge housing section configured to house the ribbon cartridge.

DESCRIPTION OF EXEMPLARY EMBODIMENTS

Figure 1:
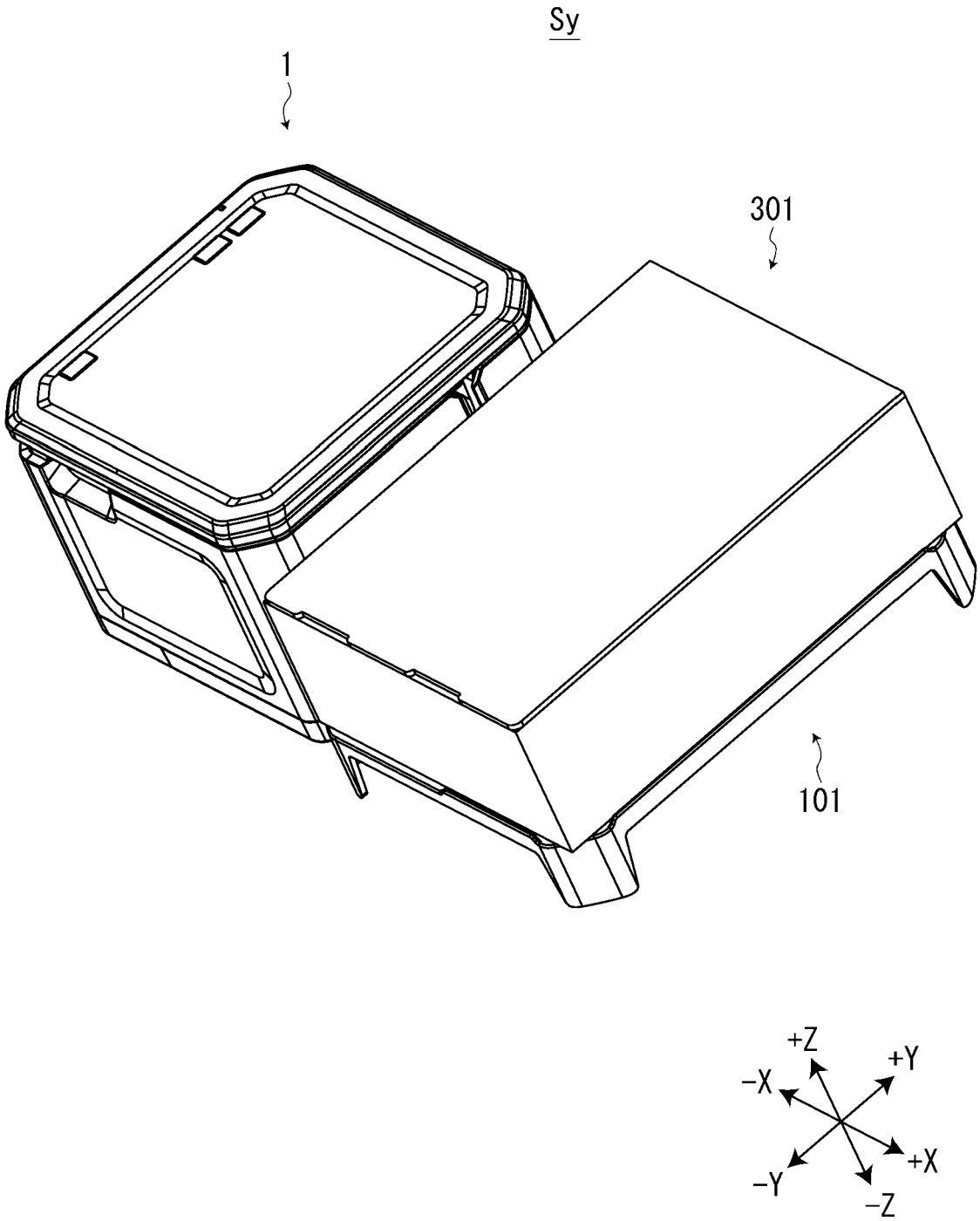
FIG. 1 is a perspective view illustrating a tape printing device, a mounting base, and a housing case that is mounted on the mounting base.

Hereinafter, a housing case and a tape ribbon set according to an embodiment will be described with reference to the attached drawings. The XYZ rectangular coordinate system in the drawings are merely for convenience, and does not limit the following embodiments at all. The +Z direction denotes an upward direction and the −Z direction denotes a downward direction. The numerical values indicating the number of components or the like are merely examples, and do not limit the following embodiments.

Tape Printing System

Figure 2:
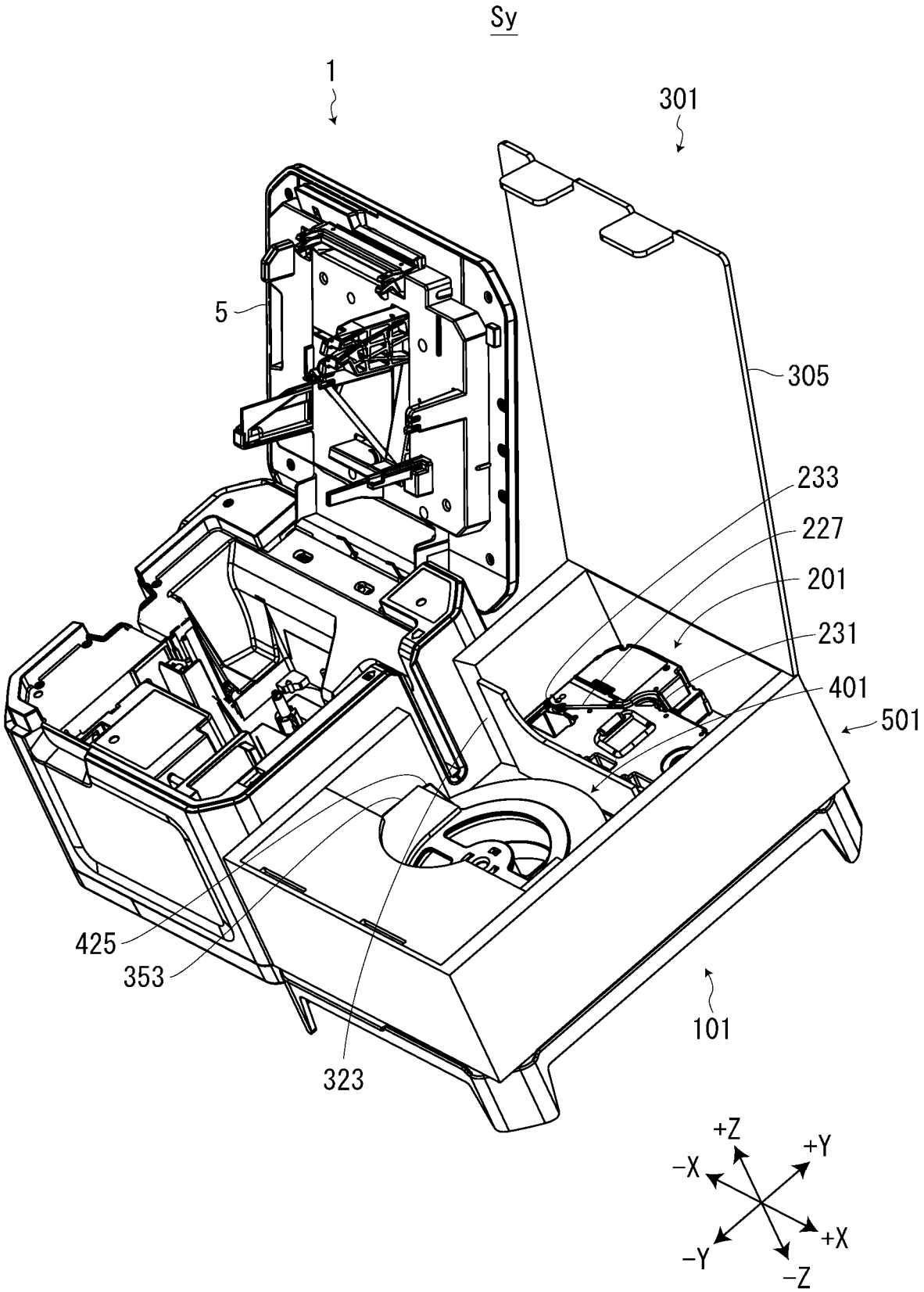
FIG. 2 is a perspective view illustrating a tape printing device, a mounting base, and a housing case that is mounted on the mounting base and houses a tape supply unit and a ribbon cartridge.
Figure 3:
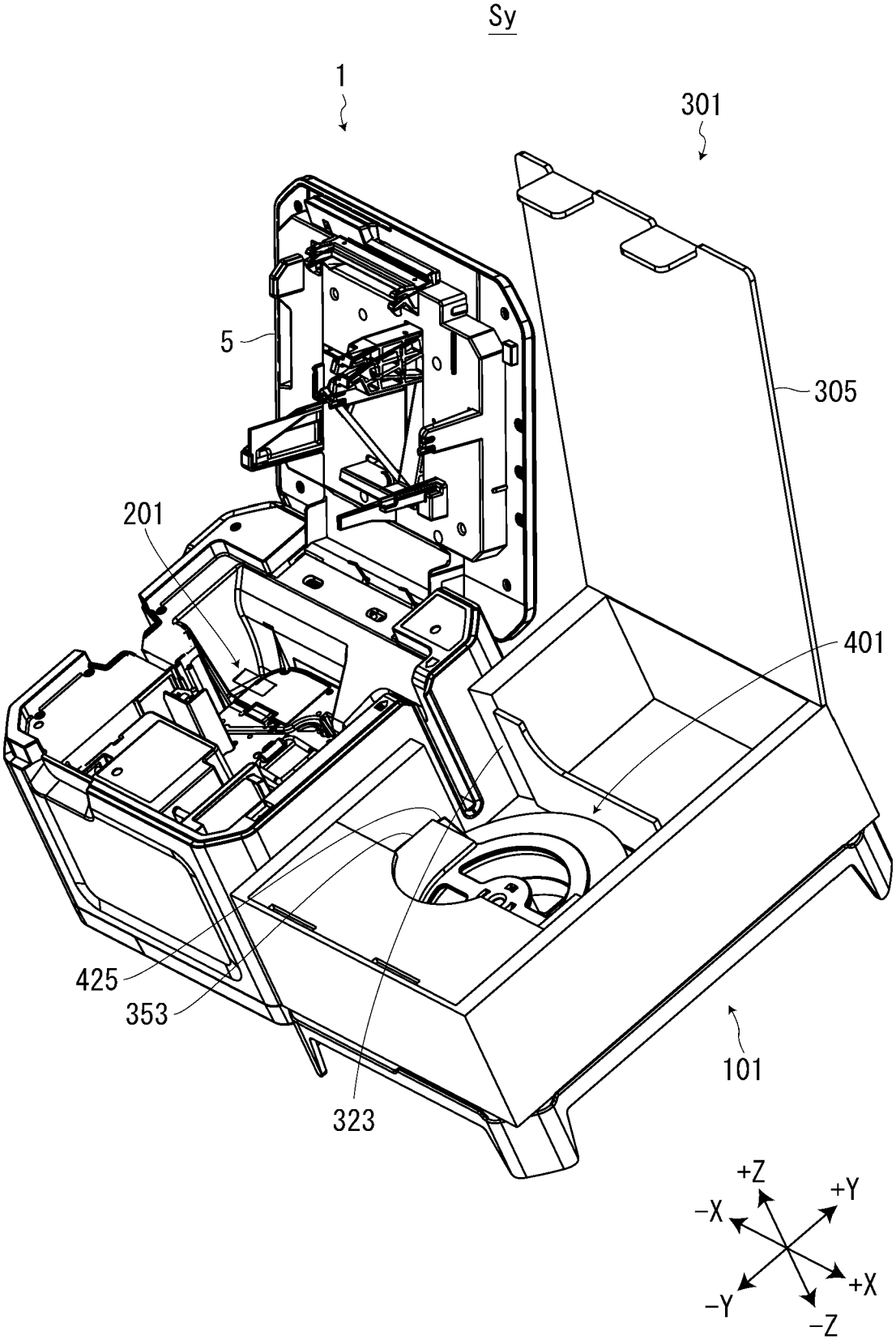
FIG. 3 is a perspective view illustrating a tape printing device with a mounted ribbon cartridge, a mounting base, and a housing case that is mounted on the mounting base and houses a tape supply unit.

As illustrated in FIG. 1 and FIG. 3, a tape printing system Sy includes a tape printing device 1 and a mounting base 101. The tape printing device 1 and the mounting base 101 are separably coupled to each other. The tape printing device 1 performs print processing based on print data received from an information processing device such as a personal computer or a smart phone (not illustrated). On the mounting base 101, a housing case 301 is mounted. The housing case 301 houses a tape supply unit 401 and a ribbon cartridge 201 (see FIG. 2). A tape ribbon set 501 includes the tape supply unit 401, the ribbon cartridge 201, and the housing case 301 that houses the tape supply unit 401 and the ribbon cartridge 201. To the tape printing device 1, the ribbon cartridge 201 that is taken from the housing case 301 is detachably attached (see FIG. 3). Furthermore, to the tape printing device 1, a tape 411 (see FIG. 6) is supplied from the tape supply unit 401 that is housed in the housing case 301.

Tape Printing Apparatus

Figure 4:
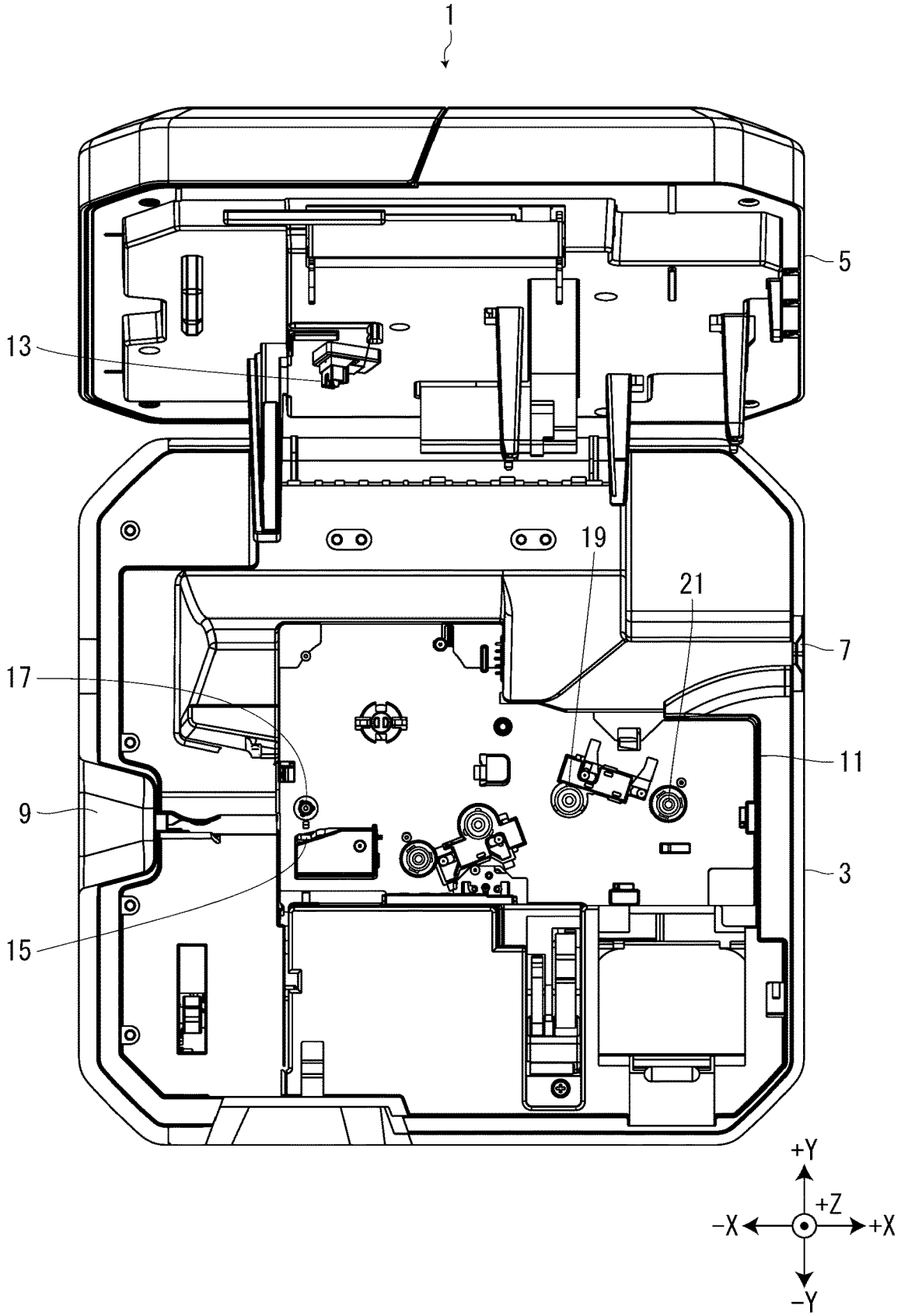
FIG. 4 illustrates a tape printing device viewed from a +Z side.

As illustrated in FIG. 4, the tape printing device 1 includes a device case 3 and an attachment section lid 5. The device case 3 has a tape feed slot 7 on the +X side and a tape discharge slot 9 on the −X side. The tape 411 fed from the tape supply unit 401 toward the tape printing device 1 is fed through the tape feed slot 7 into the device case 3. The tape 411 fed through the tape feed slot 7 discharge from the tape discharge slot 9 to the outside of the device case 3.

The attachment section lid 5 is rotatably attached to the +Y side of the device case 3 and is used to open or close a cartridge mounting section 11. On an inner surface of the attachment section lid 5, an optical sensor 13 for detecting a mount notch, which will be described below, is disposed.

The cartridge mounting section 11 is formed in a concave shape and its +Z side is open. A print head 15 is disposed on a bottom surface of the cartridge mounting section 11. The print head 15 is a thermal head that has a heating element. On the bottom surface of the cartridge mounting section 11, in the order from the −X side, a platen shaft 17, a feeding shaft 19, and a winding shaft 21 are disposed.

Ribbon Cartridge

Figure 5:
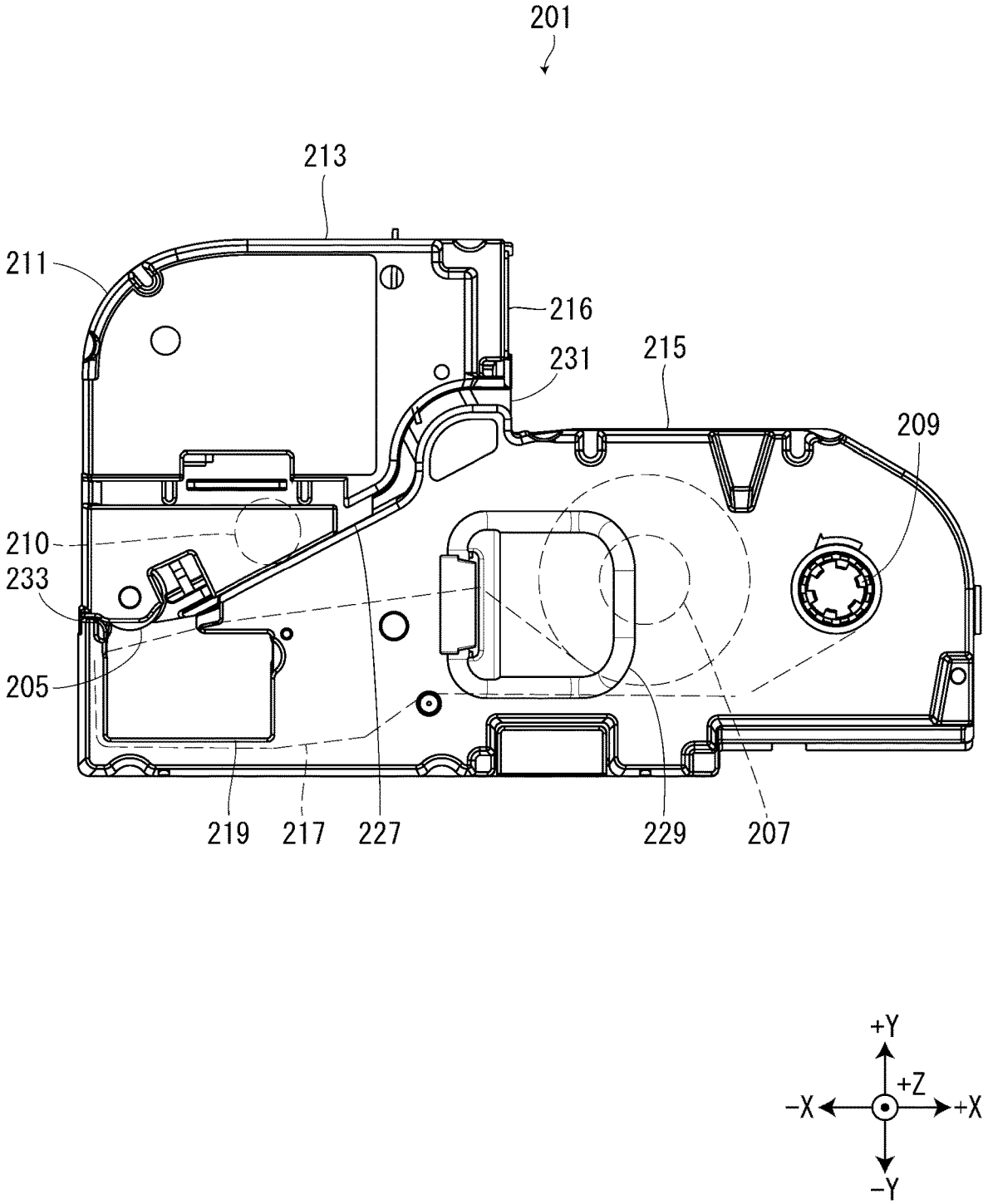
FIG. 5 illustrates a ribbon cartridge viewed from a +Z side.

As illustrated in FIG. 5, the ribbon cartridge 201 includes the platen roller 205, a feeding core 207, a winding core 209, a tape holding section 210, and a cartridge case 211 that houses these components. Around the feeding core 207, an ink ribbon 217 is wound. The ink ribbon 217 fed from the feeding core 207 is wound by the winding core 209. The carriage case 211 has a head insertion hole 219 that extends in the Z direction. When the ribbon cartridge 201 is mounted in the cartridge mounting section 11, the print head 15, the platen shaft 17, the feeding shaft 19, and the winding shaft 21 are inserted into the head insertion hole 219, the platen roller 205, the feeding core 207, and the winding core 209, respectively.

The cartridge case 211 is formed in a substantially "L" shape when viewed from the +Z side. In an end portion of the cartridge case 211 on the +Y side, a substantially half portion on the −X side is referred to as a cartridge convex portion 213. The cartridge convex portion 213 protrudes toward the +Y side with respect to a first outer side wall 215, which is the +Y side of a portion for housing the ink ribbon 217 that is wound around the feeding core 207.

The cartridge case 211 has a groove tape path 227 that has an opening on the +Z side. The tape path 227 has a path feed slot 231 at an end portion on the +X side and a path discharge slot 233 at an end portion on the −X side. The tape 411 fed through the tape feed slot 7 into the device case 3 advances through the tape path 227 in the ribbon cartridge 201 mounted in the cartridge mounting section 11 and is fed to the tape discharge slot 9. In a wall portion of the ribbon cartridge 201 on the +Z side, a finger hook portion 229 is provided. The user puts fingers on the finger hook portion 229 and pulls up the ribbon cartridge 201, and thereby the ribbon cartridge 201 is readily removed from the cartridge mounting section 11. A second outer side wall 216 that has the path feed slot 231 and the first outer side wall 215 are formed in a substantially "L" shape when viewed from the +Z side. At least one of the first outer side wall 215 and the second outer side wall 216 is an example "predetermined outer side wall".

The tape holding section 210 holds the tape 411 by nipping the tape 411 that has been fed into the tape path 227 in a state in which the ribbon cartridge 201 is not mounted in the cartridge mounting section 11 with a side wall portion of the tape path 227. With this structure, the tape 411 that has been fed into the tape path 227 is prevented from coming off the tape path 227, for example, when the user takes the ribbon cartridge 201 out of the housing case 301 and mounts the ribbon cartridge 201 into the cartridge mounting section 11.

After the attachment section lid 5 is closed with the ribbon cartridge 201 mounted in the cartridge mounting section 11, the print head 15 is moved toward the platen shaft 17 by a head moving mechanism (not illustrated). With this structure, the tape 411 and the ink ribbon 217 are nipped between the print head 15 and the platen roller 205. The platen roller 205 is rotated in this state and the tape 411 and the ink ribbon 217 are fed. During the feeding, the print head 15 is heated and a print image is printed on the tape 411 based on print data that has been received by the tape printing device 1. While the ribbon cartridge 201 is mounted in the cartridge mounting section 11, the tape holding section 210 releases the tape 411, and thus the tape holding section 210 does not interfere with the feeding of the tape 411 in the tape path 227 and the tape 411 is smoothly fed.

Tape Supply Unit

Figure 6:
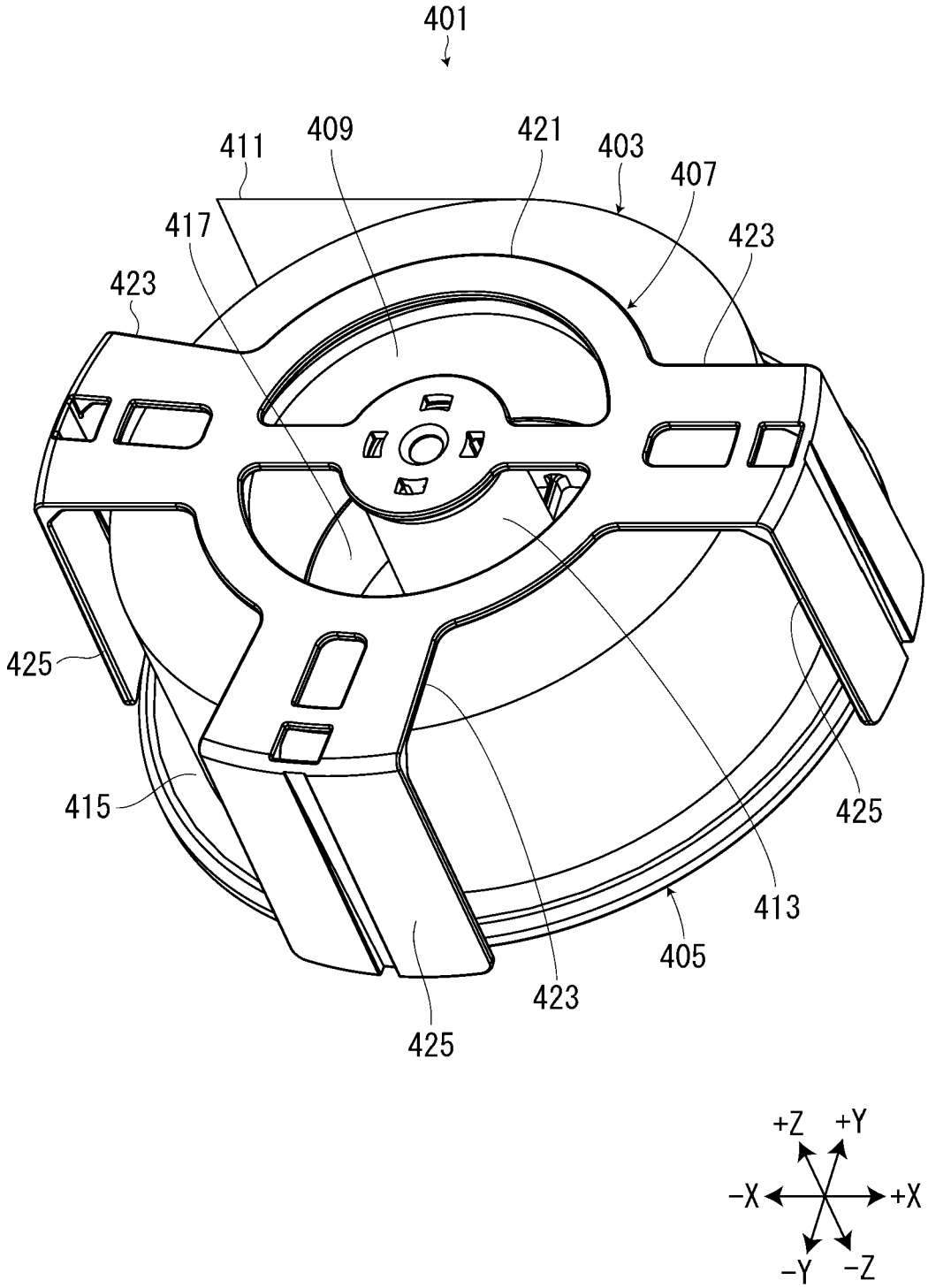
FIG. 6 is a perspective view illustrating a tape supply unit.
Figure 7:
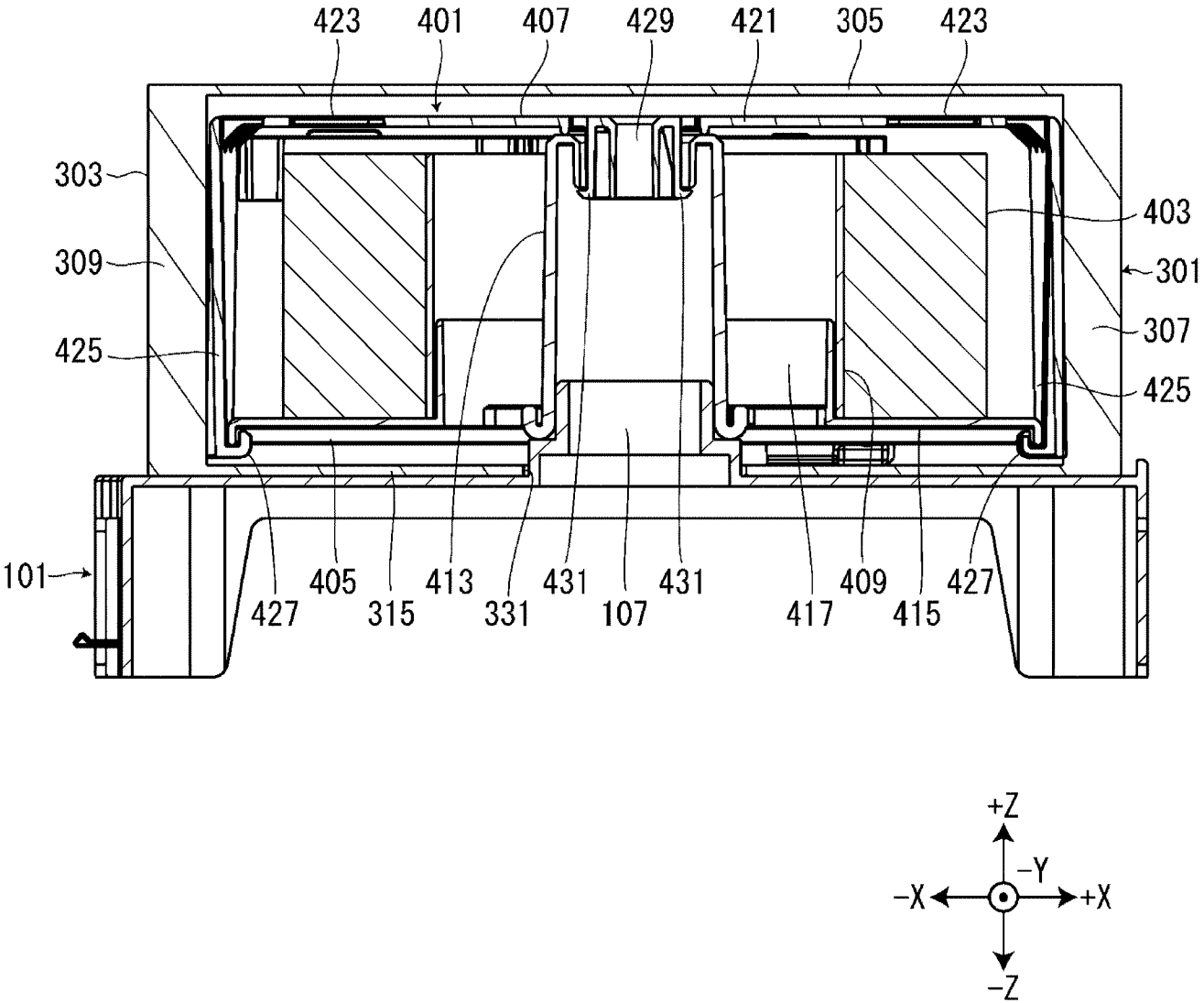
FIG. 7 is a cross-sectional view illustrating a mounting base, and a housing case that is mounted on the mounting base and houses a tape supply unit.

As illustrated in FIG. 6 and FIG. 7, the tape supply unit 401 includes a tape roll 403, a first member 405, and a second member 407.

The tape roll 403 comprises a roll core 409 and the tape 411 that is wound around the roll core 409. The tape 411 may be, for example, a print tape on which a print image is to be printed and has an adhesive surface with a release tape removably attached thereto. The tape 411 may be a die-cut tape with labels attached to a mount. The die-cut tape has mount notches to be detected by the optical sensor 13. The notches correspond to the labels and are formed at the edge of the mount on the +Z side.

On the first member 405, the tape roll 403 is mounted. The first member 405 includes a shaft section 413, a flange section 415, and a core engagement section 417. The shaft section 413 is formed in a substantially cylindrical shape. The shaft section 413 is inserted from the −Z side into the roll core 409 so as to protrude from the roll core 409. Into the shaft section 413, when the housing case 301 is mounted on the mounting base 101, a rotation support portion 107, which will be described below, is inserted from the −Z side.

The flange section 415 extends outwardly in a flange shape in the radial direction from an end portion of the shaft section 413 on the −Z side. The core engagement section 417 protrudes from a surface of the flange section 415 on the +Z side in a substantially cylindrical shape. The core engagement section 417 is inserted into the roll core 409 from the −Z side and engages with the roll core 409. Specifically, in the +Z side surface of the flange section 415, in an area outside the core engagement section 417 in the radial direction, an end surface of the tape roll 403 on the −Z side is disposed.

The second member 407 includes a disc portion 421, three riding-up restraining portions 423, three coupling portions 425, and three tape receiving portions 427.

On the −Z side of a central portion of the disc portion 421, a shaft insertion portion 429 is provided. The shaft insertion portion 429 has hook-shaped insertion side engagement portions 431. The shaft insertion portion 429 inserted into the shaft section 413 from the +Z side engages with the +Z side end portion of the shaft section 413 at the insertion side engagement portions 431. With this structure, the shaft section 413 and the shaft insertion section 429 are rotatably coupled with each other.

The riding-up restraining portions 423 are provided on the side opposite to the first member 405 with respect to the tape roll 403, that is, on the +Z side of the tape roll 403. The riding-up restraining portions 423 extend outwardly in the radial direction from the outer edge portion of the disc portion 421, and face the +Z-side end surface of the tape roll 403. The riding-up restraining portions 423 control the tape 411 when the tape roll 403 unwinds such that the tape 411 is prevented from riding up the +Z side of the tape roll 403. The tape 411 that has ridden up on the tape roll 403 may be bent or deformed and may cause a print failure.

The coupling portions 425 are provided outside the tape roll 403 in the radial direction to couple the riding-up restraining portions 423 and the tape receiving portions 427. The coupling portions 425 extend in the Z direction and face an outer circumferential surface of the tape roll 403.

As illustrated in FIG. 7, the tape receiving portions 427 are provided on the side opposite to the tape roll 403 with respect to the first member 405, that is, on the −Z side of the first member 405. The tape receiving portions 427 protrude inwardly in the radial direction from an end portion of the coupling portions 425 on the −Y side. When the tape roll 403 unwinds, the tape receiving portions 427 receive the tape 411 dropped from the first member 405 to prevent the tape 411 from further dropping from the first member 405.

Mounting Base

Figure 8:
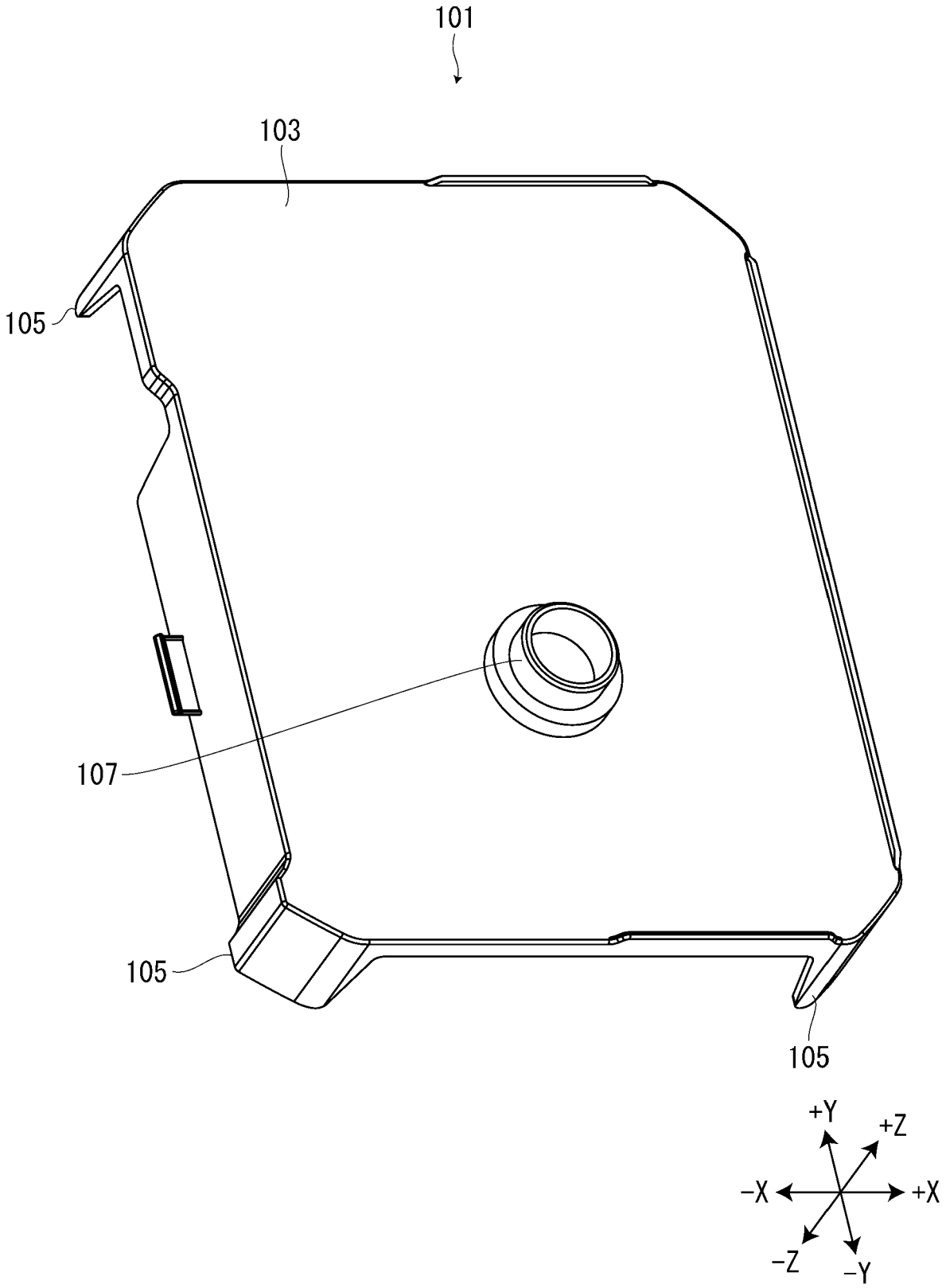
FIG. 8 is a perspective view illustrating a mounting base.

As illustrated in FIG. 7 and FIG. 8, the mounting base 101 includes a mounting portion 103, four leg portions 105, and the rotation support portion 107. The mounting portion 103 is formed in a substantially rectangular plate-like shape, and the housing case 301 is to be mounted thereon. The four leg portions 105 are provided on the −Z side of the four corners of the mounting portion 103 to support the mounting portion 103.

The rotation support portion 107 protrudes in a substantially cylindrical shape toward the +Z side from a portion of the mounting portion 103 closer to the −Y side. The housing case 301 is mounted on the mounting base 101, and the rotation support portion 107 is inserted into the shaft portion 413 of the first member 405 to rotatably support the first member 405 and the tape roll 403 mounted on the first member 405.

Container

The housing case 301 houses the tape supply unit 401 and the ribbon cartridge 201. Although the housing case 301 is not limited to a particular material, for example, the housing case is made of paper such as cardboard such that a tape discharge side removal portion 317 and a support section insertion side removal portion 325, which will be described below, can be readily removed.

Figure 9:
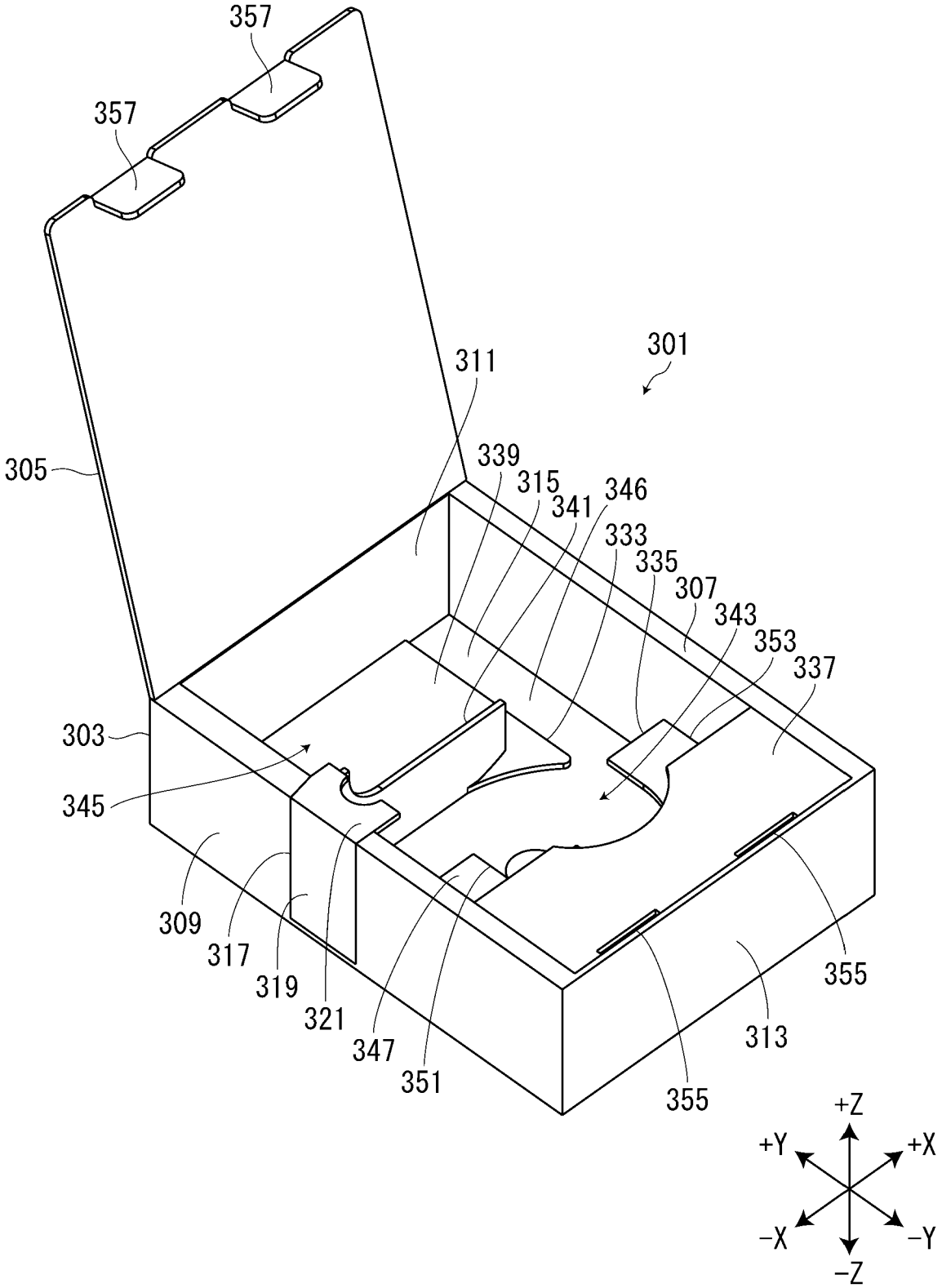
FIG. 9 is a perspective view illustrating a housing case.
Figure 10:
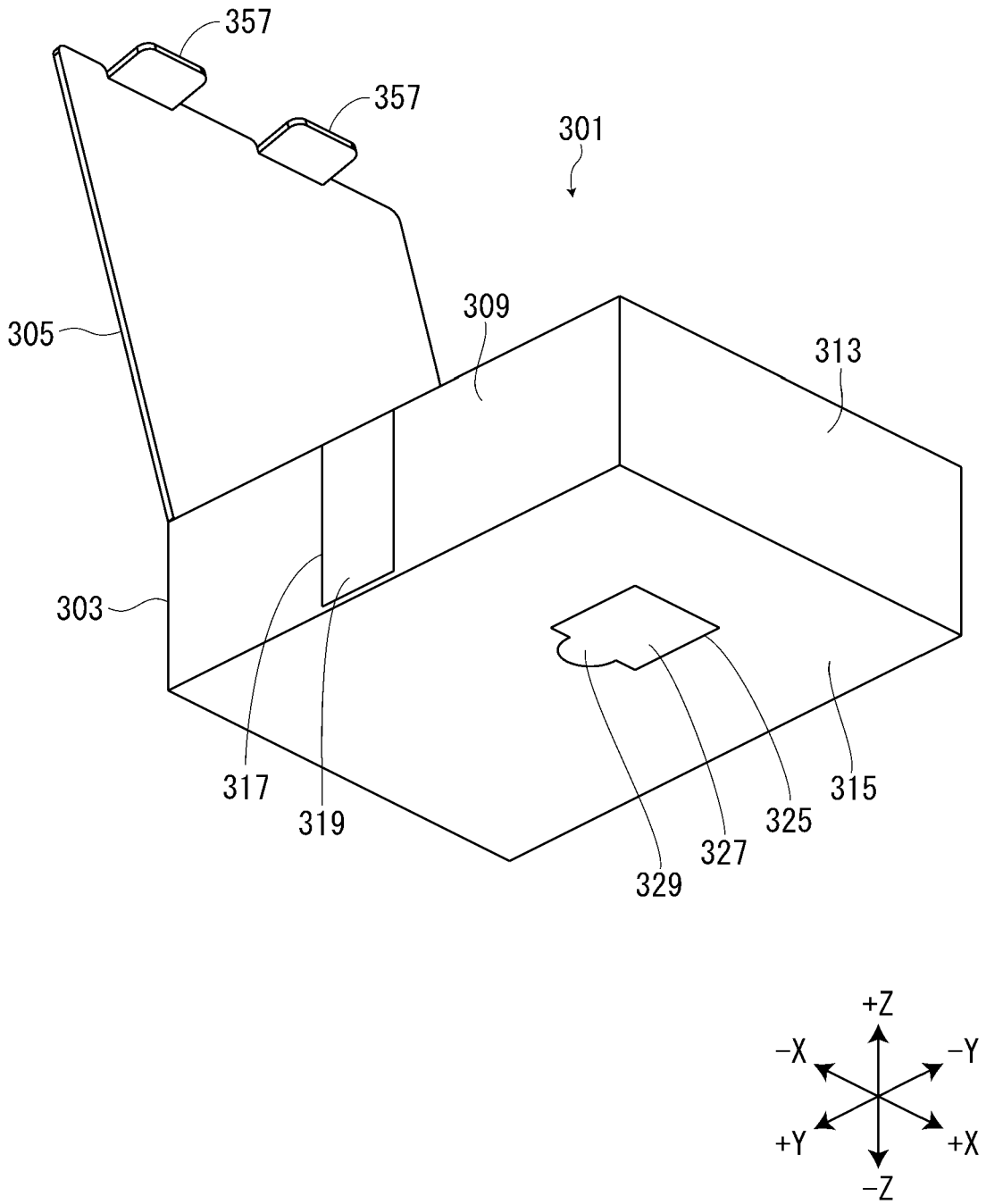
FIG. 10 is a perspective view illustrating the housing case viewed from an angle different from FIG. 9.
Figure 11:
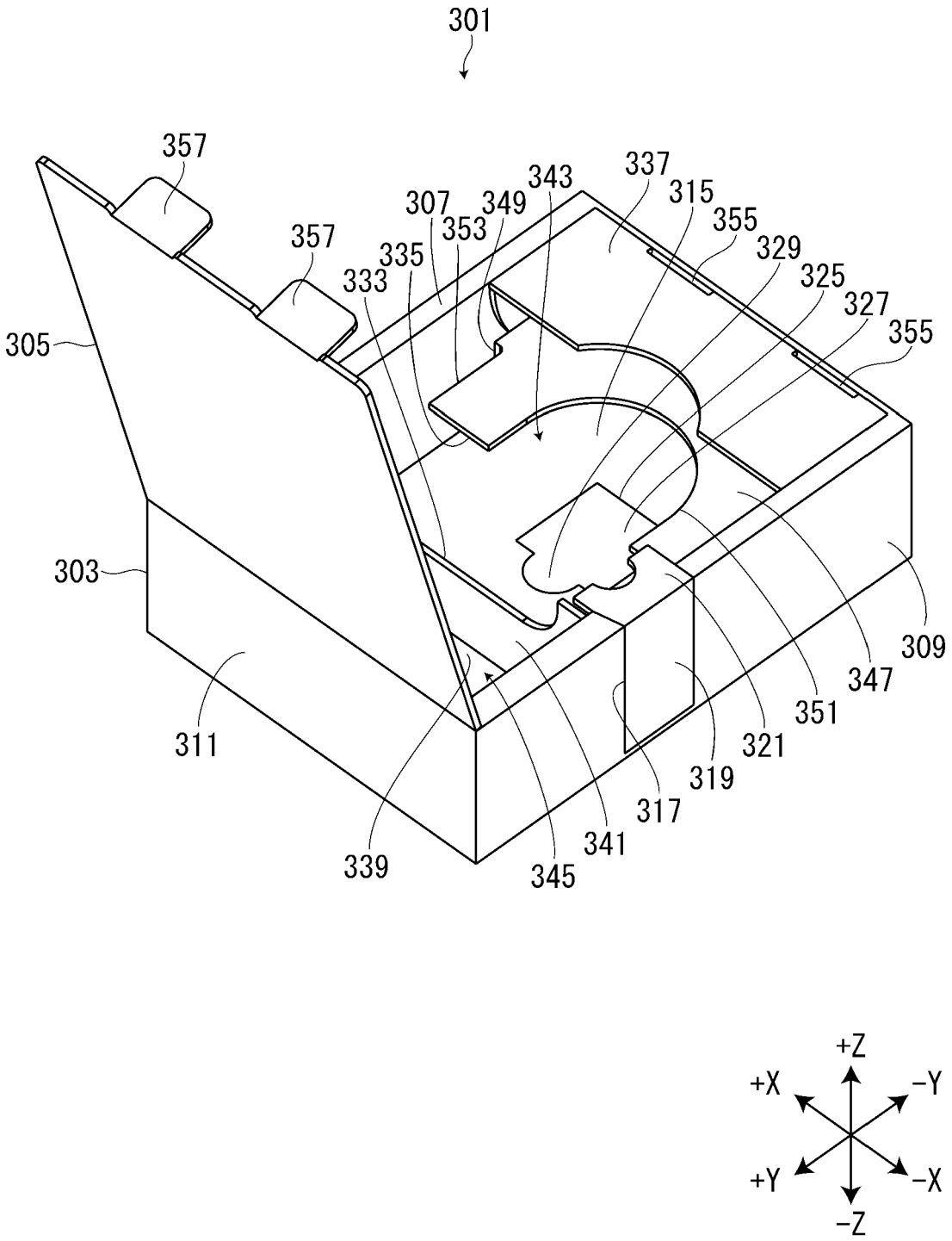
FIG. 11 is a perspective view illustrating the housing case viewed from an angle different from FIG. 9 and FIG. 10.

As illustrated in FIG. 9 to FIG. 11, the housing case 301 includes a housing case body 303 and a housing case lid portion 305. The body 303 is formed in a substantially rectangular parallelepiped shape with an opening on the +Z side, and includes a first side wall section 307 on the +X side, a second side wall section 309 on the −X side, a third side wall section 311 on the +Y side, a fourth side wall section 313 on the −Y side, and a bottom wall section 315 on the −Z side. In the tape printing system Sy, the second side wall section 309 is adjacent to the tape printing device 1, and the bottom wall section 315 is close to or in contact with the mounting portion 103 of the mounting base 101.

The second side wall section 309 has the tape discharge side removal portion 317 on the −X side of a supply unit housing section 343, which will be described below. The tape discharge side removal portion 317 includes a first tape discharge side removal portion 319 and a second tape discharge side removal portion 321. The substantially rectangular plate-like first tape discharge side removal portion 319 is a part of the second side wall section 309. The second tape discharge side removal portion 321 is rotatably connected to an end portion of the first tape discharge side removal portion 319 on the +Z side and has a concave end portion that is notched in a substantially semicircular shape. The outline of the first tape discharge side removal portion 319 is perforated such that the first tape discharge side removal portion 319 can be removed from the second side wall section 309. For example, the user grasps and pulls the second tape discharge side removal portion 321 to remove the first tape discharge side removal portion 319 from the second side wall section 309. The second side wall section 309 is an example "first wall section".

Removing the tape discharge side removal portion 317 from the second side wall section 309 forms a tape discharge portion 323 (see FIG. 2 and FIG. 3) in the second side wall section 309. The tape 411 fed from the tape roll 403 in the tape supply unit 401 that is housed in the housing case body 303 is fed from the tape discharge portion 323 toward the tape feed slot 7 in the adjacent tape printing device 1. The tape discharge portion 323 is configured to have a width, that is, the dimension of the tape discharge portion 323 in the Y direction such that the tape 411 is prevented from coming into contact with the edge portions of the tape discharge portion 323 due to a tape feed path change caused by a change in winding diameter of the tape roll 403.

At a location closer to the −Y side in the bottom wall section 315, the support section insertion side removal portion 325 is provided. The support section insertion side removal portion 325 includes a first support section insertion side removal portion 327 and a second support section insertion side removal portion 329. The substantially rectangular plate-like first support section insertion side removal portion 327 is a part of the bottom wall section 315. The second support section insertion side removal portion 329 is connected to an end portion of the first support section insertion side removal portion 327 on the +Y side and protrudes in a substantially semicircular shape. The second support section insertion side removal portion 329 is a part of the bottom wall section 315. The outline of the first support section insertion side removal portion 327 and the outline of the second support section insertion side removal portion 329 is perforated such that the first support section insertion side removal portion 327 and the second support section insertion side removal portion 329 can be removed from the bottom wall section 315. For example, a user folds the second support section insertion side removal portion 329 toward the +Z side or the −Z side and grasps and pulls the folded second support section insertion side removal portion 329 to remove the first support section insertion side removal portion 327 and the second support section insertion side removal portion 329 from the bottom wall section 315. The bottom wall section 315 is an example "second wall section".

Removing the support section insertion side removal portion 325 from the bottom wall section 315 forms a support section insertion portion 331 (see FIG. 7) in the bottom wall section 315. When the housing case 301 is mounted on the mounting base 101, the rotation support portion 107 is inserted through the support section insertion portion 331 into the shaft portion 413. With this structure, by removing the support section insertion side removal portion 325, the support section insertion portion 331 is formed in the bottom wall section 315, enabling the rotation support portion 107 to rotatably support the first member 405 and the tape roll 403 with the tape supply unit 401 being housed in the housing case 301 without taking the tape supply unit 401 out of the housing case 301.

In the housing case body 303, a first housing member 333, a second housing member 335, and a third housing member 337 are provided.

The first housing member 333 is disposed near a corner on the −X side and the +Y side of the housing case body 303. The first housing member 333 includes a base portion 339 and a partition portion 341. On the base portion 339, the ribbon cartridge 201 is disposed. The partition portion 341 is bent and extends from an end portion of the base portion 339 on the −Y side toward the +Z side. The partition section 341 extends from an end portion of the tape discharge side removal portion 317 on the −X side in the +X direction and partitions the space in the housing case body 303 into the supply unit housing section 343 on the −Y side and a cartridge housing section 345 on the +Y side. In the supply unit housing section 343, the tape supply unit 401 is housed. In the cartridge housing section 345, the ribbon cartridge 201 is housed such that the path feed slot 231 is on the +X side and the path discharge slot 233 is on the −X side (see FIG. 2). The partition section 341 prevents the ribbon cartridge 201 from coming in contact with the housed tape supply unit 401 and causing damage to the tape 411. The supply unit housing section 343 is an example "tape roll housing section".

Between the partition section 341 and the first side wall section 307, a tape passage portion 346 (see FIG. 9) is provided. The tape 411 is fed from the tape supply unit 401 that is housed in the supply unit housing section 343 and passes through the tape passage portion 346 toward the ribbon cartridge 201 that is housed in the cartridge housing section 345. The tape 411 fed from the tape supply unit 401 is advanced toward the +Y side toward the tape passage portion 346, and further fed through the path feed slot 231 toward the tape path 227.

The second housing member 335 is disposed near an end portion of the housing case body 303 on the −Y side. The second housing member 335 includes a notch portion 347 and two support portions 349 (only one of the support portions 349 is illustrated in FIG. 11). The notch portion 347 is located on the +Z side of a tape supply unit 401 that is housed in the supply unit housing section 343, and an end portion of the notch portion 347 on the +Y side has a first notch portion 351 and two second notch portions 353. The substantially semicircular first notch portion 351 is located at a substantially central portion of the notch portion 347 in the X direction. The two second notch portion 353 are located at both ends of the notch portion 347 in the X direction, and formed in a substantially rectangular shape long in the Y direction. The first notch portion 351 is largely notched as compared with the two second notch portions 353. The two support portions 349 are bent and extend from both ends of the notch portion 347 in the X direction toward the −Z side, and are located on the −Y side of the second notch portions 353 when viewed from the +Z side.

The tape supply unit 401 is housed in the supply unit housing section 343 (see FIG. 2 and FIG. 3) such that the two coupling portions 425 out of the three coupling portions 425 are accommodated in the two second notch portions 353. The support portions 349 are, specifically, located on the −Y side of the coupling portions 425 that are accommodated in the second notch portions 353. With this structure, when the second member 407 is rotated, one of the two coupling portions 425 comes into contact with the support portion 349, and the second member 407 is prevented from rotating further. Accordingly, the support portions 349 function as a "rotation stopping section" for stopping the rotation of the second member 407. As described above, the shaft portion 413 of the first member 405 and the shaft insertion portion 429 of the second member 407 are rotatably coupled to each other, and the first member 405 can rotate even when the rotation of the second member 407 is stopped by the support portion 349.

In the tape printing device 1, when the platen roller 205 is rotated and the tape 411 is fed from the tape roll 403, the tape roll 403 and the first member 405 rotate together. However, if a structure different from the embodiment in which the second member 407 rotates together with the tape roll 403 and the first member 405 is employed, the coupling portion 425 of the second member 407 will catch on the tape 411 fed from the tape roll 403. On the other hand, in this embodiment, when the tape roll 403 and the first member 405 rotate together, the support portion 349 prevents the rotation of the second member 407. Accordingly, the coupling portion 425 of the second member 407 is prevented from catching on the tape 411 fed from the tape roll 403.

The third housing member 337 is disposed on the +Z side of the second housing member 335. In an end portion of the third housing member 337 on the −Y side, two lid fitting openings 355 are provided. Each of the lid fitting openings 355 is formed in a substantially rectangular shape long in the X direction.

The housing case lid portion 305 opens or closes the opening on the +Z side of the housing case body 303. The housing case lid portion 305 is opened, for example, to attach the ribbon cartridge 201 to the housing case body 303 or detach the ribbon cartridge 201 from the housing case body 303. The housing case lid portion 305 is rotatably provided on the +Y side of the housing case body 303 similarly to the attachment section lid 5 that is rotatably provided on the +Y side of the device case 3 in the tape printing device 1. With this structure, as illustrated in FIG. 2 and FIG. 3, the attachment section lid 5 and the housing case lid portion 305 can be opened in the same direction in a state in which the tape printing device 1 and the mounting base 101 are coupled to each other and the housing case 301 is mounted on the mounting base 101. Accordingly, the attachment section lid 5 and the housing case lid portion 305 can be readily opened or closed, and the space necessary for the installation of the tape printing device 1 and the housing case 301 can be saved.

In an end portion of the housing case lid portion 305 on the −Y side, two lid fitting pieces 357 are provided. The two lid fitting pieces 357 are inserted into the two lid fitting openings 355 in the housing case body 303 when the housing case lid portion 305 is closed. With this structure, the housing case lid portion 305 can be maintained in the closed state.

As described above, the housing case 301 according to the embodiment houses the ribbon cartridge 201 together with the tape supply unit 401, and thus the ribbon cartridge 201 can be housed in a state in which the ribbon cartridge 201 is holding the tape 411 fed from the tape supply unit 401. Accordingly, the user can set the tape 411 and the ribbon cartridge 201 in the tape printing device 1 by simply taking the ribbon cartridge 201 that is holding the tape 411 out of the housing case 301 and mounting the ribbon cartridge 201 to the tape printing device 1.

Furthermore, by removing the tape discharge side removal portion 317, the tape discharge portion 323 is formed in the second side wall section 309 adjacent to the tape feed slot 7 in the tape printing device 1, and the tape 411 can be fed from the tape supply unit 401 to the tape printing device 1 while the tape supply unit 401 is housed in the housing case 301 without taking the tape supply unit 401 out of the housing case 301.

Modifications of Container

Figure 12:
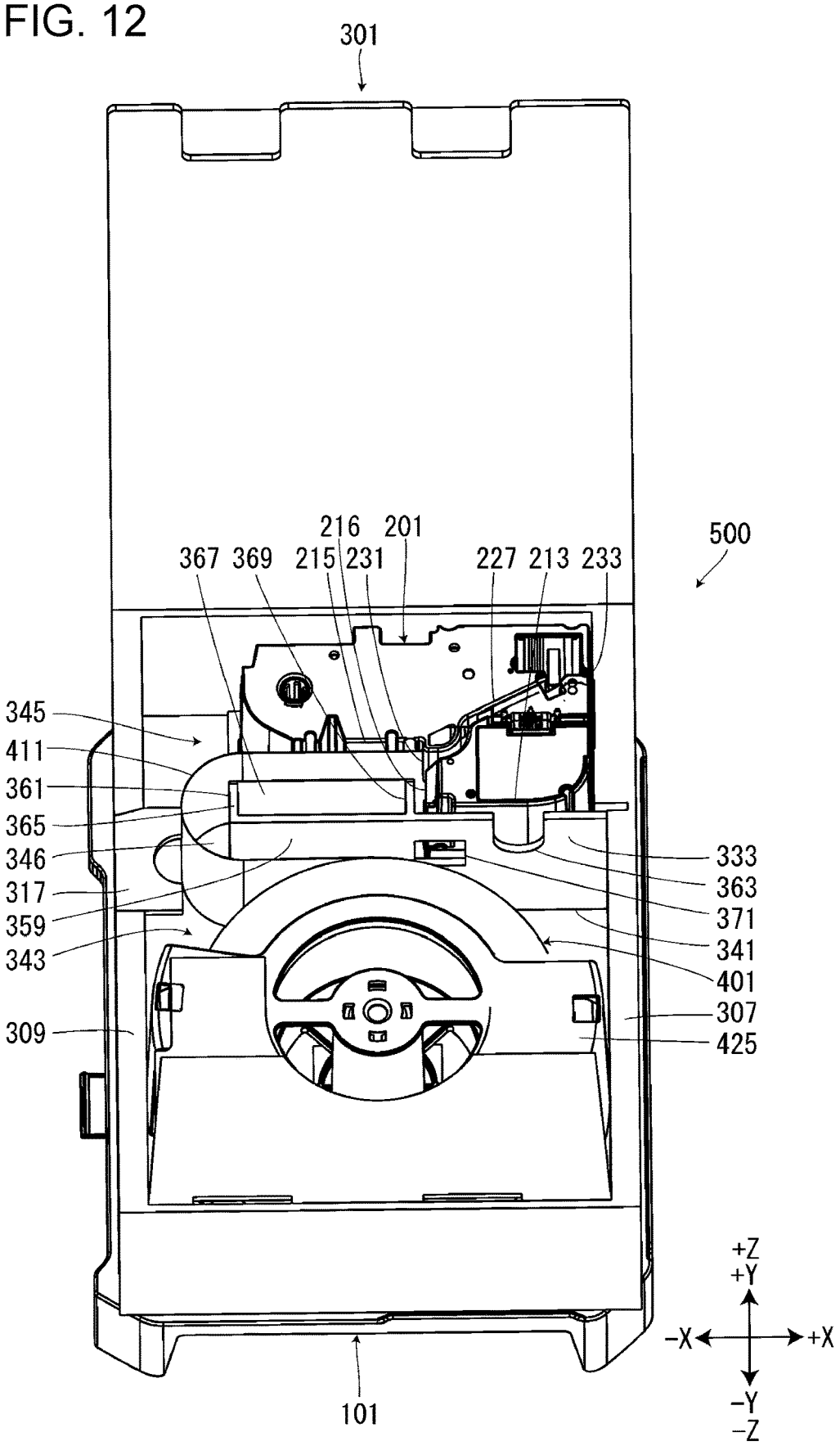
FIG. 12 is a perspective view illustrating a modification of the housing case.
Figure 13:
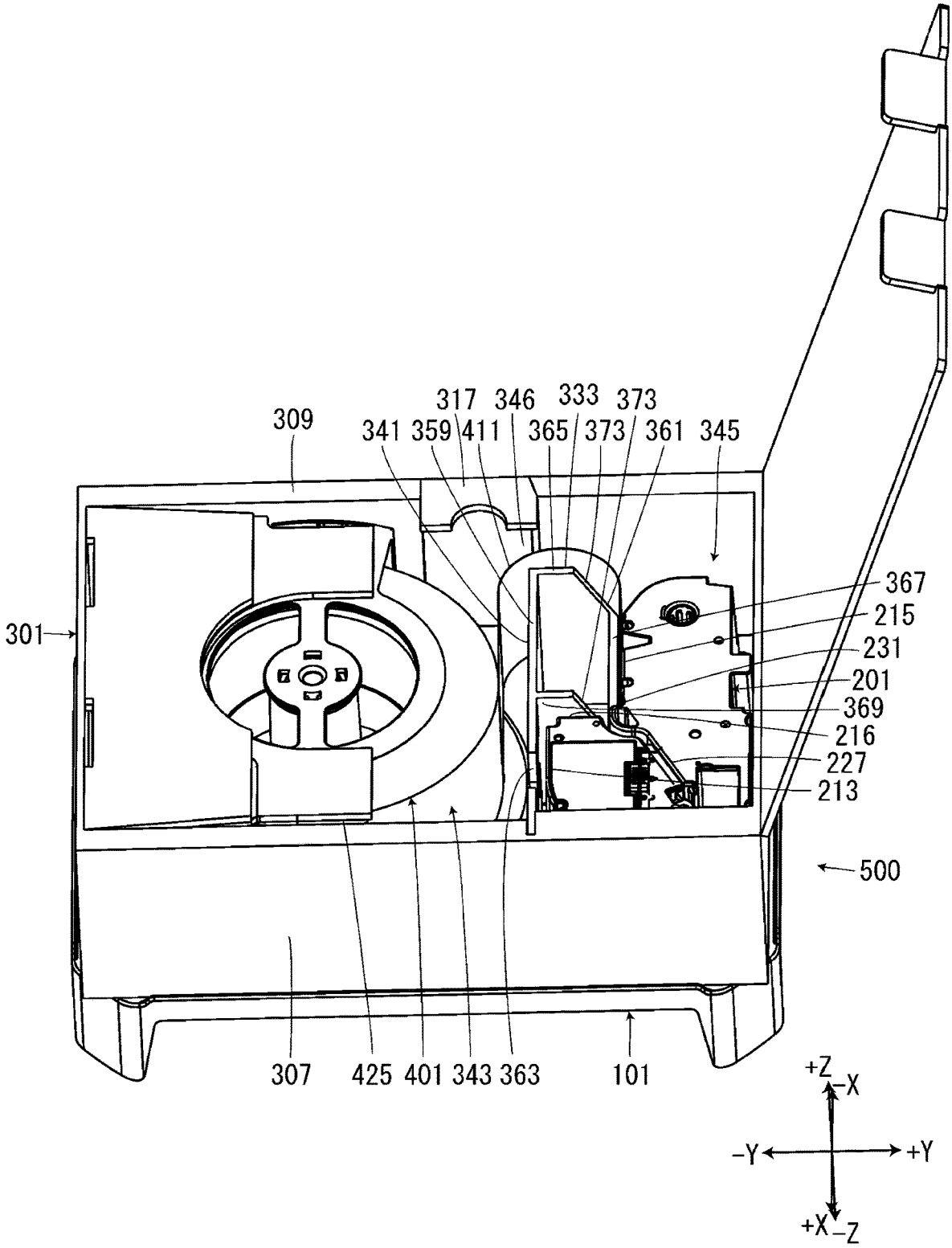
FIG. 13 is a perspective view illustrating the modified housing case viewed from an angle different from FIG. 12.

In the housing case 301, the tape passage portion 346 is not limited to the structure in which the tape passage portion 346 is provided between the first side wall section 307 and the partition section 341, and may be provided between the second side wall section 309 and the partition portion 341 as illustrated in FIG. 12 and FIG. 13. In this structure, the ribbon cartridge 201 is housed in the cartridge housing section 345 in an orientation rotated 180° with respect to the above-described ribbon cartridge 201 that is housed in the housing case 301, that is, the path feed slot 231 is on the −X side and the path discharge slot 233 is on the +X side. The tape 411 fed from the tape supply unit 401 is advanced toward the −X side toward the tape discharge side removal portion 317 provided in the second side wall section 309, further makes a U-turn toward the +X side at the tape passage portion 346, and is fed through the path feed slot 231 toward the tape path 227.

In this modification, as compared with the structure in which the tape passage portion 346 is provided between the first side wall section 307 and the partition portion 341, the tape passage portion 346 is provided near the tape discharge side removal portion 317. With this structure, when the ribbon cartridge 201 is housed in the housing case 301, the tape 411 of a length necessary for the user to take the ribbon cartridge 201 out of the housing case 301 and mount the ribbon cartridge 201 in the tape printing device 1, or the tape of a length close to the length has been fed in advance. Accordingly, the length of the tape 411 that is to be pulled from the tape supply unit 401 can be reduced when the user takes the ribbon cartridge 201 out of the housing case 301 and mounts the ribbon cartridge 201 into the tape printing device 1, and thus the user can smoothly mount the ribbon cartridge 201 into the tape printing device 1. In particular, the modification is useful when a die-cut tape is used for the tape 411 because mount notches of the die-cut tape 411 tend to catch on the coupling portion 425 when the tape 411 is pulled.

The partition portion 341 provided in the housing case 301 according to the modification includes a partition body 359 and a partition convex portion 361. The partition body 359 extends in the X direction from the first side wall section 307 toward an end portion of the tape discharge side removal portion 317 on the +Y side. The partition convex portion 361 protrudes from a substantially half portion of the partition body 359 on the −X side toward the +Y side, that is, toward the cartridge housing section 345. The partition convex portion 361 engages with the first outer side wall 215 and the second outer side wall 216 of the ribbon cartridge 201. Specifically, the cartridge convex portion 213 is inserted between the partition convex portion 361 and the first side wall section 307. With this structure, the ribbon cartridge 201 can be held without providing a member in addition to the partition portion 341. Accordingly, the rattle of the ribbon cartridge 201 inside the housing case 301 during the transportation of the housing case 301 can be suppressed. The partition convex portion 361, preferably, engages with both the first outer side wall 215 and the second outer side wall 216, but may engage with one of the first outer side wall 215 and the second outer side wall 216.

A substantially semicircular partition notch 363 is provided in an edge portion on the +Z side of the partition body 359 at a location closer to the +X side than the partition convex portion 361, that is, to correspond to the cartridge convex portion 213. The user can readily hold the ribbon cartridge 201 that is mounted in the cartridge housing section 345 through the partition notch 363. A plurality of partition notches 363 may be provided, or the notch may be provided in the partition convex portion 361.

The partition body 359 and the partition convex portion 361 are integrally formed, for example, by folding a plurality of times a plate-like cardboard first housing member 333. The partition convex portion 361 includes a first convex wall portion 365, a second convex wall portion 367, and a third convex wall portion 369. The first convex wall portion 365 extends from an end portion of the partition body 359 on the −X side toward the +Y side. The second convex wall portion 367 extends from an end portion of the first convex wall portion 365 on the +Y side toward the +X side. The third convex wall portion 369 extends from an end portion of the second convex wall portion 367 on the +X side toward the −Y side. At a substantially middle portion of the partition body 359 in the X direction, a substantially rectangular fixation opening 371 is provided. To the fixation opening 371, an end portion of the third convex wall portion 369 is fixed. The tape 411 fed from the tape supply unit 401 is held by the second convex wall portion 367 and the first outer side wall 215. Between the second convex wall portion 367 of the partition convex portion 361 and the first outer side wall 215, the tape 411 is pressed by the surfaces from the two opposing directions, and thus if the ribbon cartridge 201 rattles within the housing case 301, damage to the tape 411 can be suppressed.

The second convex wall portion 367 is lower than the partition body 359, and the first convex wall portion 365 and the third convex wall portion 369 provided between the partition body 359 and the second convex wall portion 367 have housing case guide slopes 373. The housing case guide slope 373 is inclined such that the partition body 359 side is the +Z side and the second convex wall portion 367 side is the −Z side. The housing case guide slopes 373 guide the ribbon cartridge 201 toward the cartridge housing section 345 in mounting the ribbon cartridge 201 into the cartridge housing section 345.

Other Modifications

It is to be understood that the present disclosure is not limited to the above-described embodiments, various modifications can be made without departing from the scope of the disclosure. For example, in addition to the above-described embodiments, the embodiments may be modified as described below.

The "rotation stopping section" is not limited to the structure such as the support portion 349 that comes into contact with the coupling portion 425 to prevent the second member 407 from rotating. For example, the "rotation stopping section" may come into contact with the riding-up restraining portion 423 to prevent the second member 407 from rotating. Furthermore, the "rotation stopping section" may have a cross section complementary to a non-circular hole in the shaft insertion portion 429 and may be inserted into the hole to prevent the second member 407 from rotating.

The housing case 301 may not be mounted on the mounting base 101, and may be directly placed on a surface on which the tape printing device 1 has been installed and the tape 411 may be fed from the housed tape supply unit 401 toward the tape printing device 1. The housing case 301 may be mounted on the mounting base 101 that is inseparably integrated with the tape printing device 1.

Supplementary Notes

Hereinafter, supplementary notes of a housing case and a tape ribbon set will be described. A housing case includes a tape roll housing section configured to house a tape roll of a wound tape to be fed to a tape printing device, a tape discharge side removal portion removably provided in a first wall section, the tape discharge side removal portion to be removed to form a tape discharge in the first wall section through which the tape fed from the tape roll is fed, and a cartridge housing section configured to house a ribbon cartridge having an ink ribbon, the ribbon cartridge to be mounted into the tape printing device and being configured to hold the tape fed from the tape roll.

With this structure, the ribbon cartridge is housed together with the tape roll, and thus the ribbon cartridge can be housed while the ribbon cartridge is holding the tape fed from the tape roll. Accordingly, the user can set the tape and the ribbon cartridge into the tape printing device by simply taking the ribbon cartridge that is holding the tape out of the housing case and mounting the ribbon cartridge into the tape printing device.

The housing case may include a partition section for partitioning the tape roll housing section and the cartridge housing section.

With this structure, when the user carries the housing case, the ribbon cartridge is prevented from coming into contact with the housed tape roll and causing damage to the tape.

In the tape roll housing section, the tape roll and a tape supply unit having a first member on which one end surface of the tape roll is mounted and a second member may be housed, and the second member may include a riding-up restraining portion disposed on a side opposite to the first member with respect to the tape roll, the riding-up restraining portion being configured to control the tape so as not to ride up the tape roll, a tape receiving portion disposed on a side opposite to the tape roll with respect to the first member, the tape receiving portion being configured to receive the tape dropping from the first member, and a coupling portion disposed outside the tape roll in the radial direction, the coupling portion being configured to couple the riding-up restraining portion and the tape receiving portion. The tape roll housing section may include a rotation stopping section configured to stop the rotation of the second member when the tape is fed from the tape roll and the tape roll and the first member rotate together.

With this structure, when the tape roll and the first member rotate together, the rotation stopping section prevents the rotation of the second member. Accordingly, the coupling portion of the second member is prevented from catching on the tape fed from the tape roll.

In this structure, the rotation stopping section may come into contact with the coupling portion to prevent the second member from rotating.

With this structure, by using the coupling portion, the rotation of the second member can be prevented.

In this structure, a tape passage portion through which the tape fed from the tape roll toward the ribbon cartridge passes may be provided between the first wall section and the partition section.

With this structure, the length of the tape that is to be pulled from the tape roll can be reduced when the user takes the ribbon cartridge out of the housing case and mounts the ribbon cartridge into the tape printing device, and thus the user can smoothly mount the ribbon cartridge into the tape printing device.

In this structure, the partition section may include a partition body and a partition convex portion protruding from the partition body toward the cartridge housing section, and the partition convex portion engages with a predetermined outer side wall of the ribbon cartridge when the ribbon cartridge is housed in the cartridge housing section.

With this structure, the ribbon cartridge can be held without providing a member in addition to the partition section.

In this structure, the partition body and the partition convex portion may be integrally formed by folding a plurality of times a plate-like member.

With this structure, the partition body and the partition convex portion can be provided in the simple structure.

In this structure, a support section insertion side removal portion may be removably provided in the second wall section, and removing the support section insertion side removal portion forms, in the second wall section, a support section insertion portion through which a rotation support portion configured to rotatably support the tape roll is to be inserted.

With this structure, by removing the support section insertion side removal portion, a support section insertion portion is formed in the second wall section, enabling a rotation support portion to rotatably support the tape roll with the tape roll being housed in the housing case without taking the tape roll out of the housing case.

A tape ribbon set include a tape roll of a wound tape to be fed to a tape printing device, a ribbon cartridge having an ink ribbon, the ribbon cartridge to be mounted into the tape printing device and being configured to hold the tape fed from the tape roll, and a housing case configured to house the tape roll and the ribbon cartridge. The housing case includes a tape roll housing section configured to house the tape roll, a tape discharge side removal portion removably provided in a first wall section, the tape discharge side removal portion to be removed to form a tape discharge in the first wall section through which the tape fed from the tape roll is fed, and a cartridge housing section configured to house the ribbon cartridge.

With this structure, the ribbon cartridge is housed together with the tape roll, and thus the ribbon cartridge can be housed while the ribbon cartridge is holding the tape fed from the tape roll. Accordingly, the user can set the tape and the ribbon cartridge into the tape printing device by simply taking the ribbon cartridge that is holding the tape out of the housing case and mounting the ribbon cartridge into the tape printing device.

What is claimed is:

1. A housing case comprising:

a tape roll housing section configured to house a tape roll of a wound tape to be fed to a tape printing device that is located outside the housing case;

a tape discharge side removal portion removably provided in a first wall section, the tape discharge side removal portion to be removed to form a tape discharge in the first wall section through which the tape fed from the tape roll exits the housing case and is fed to the tape printing device; and a cartridge housing section configured to house a ribbon cartridge having an ink ribbon, the ribbon cartridge and the ink ribbon to be removed out of the housing case and mounted into the tape printing device and the ribbon cartridge being configured to hold the tape fed from the tape roll.

2. The housing case according to claim 1, further comprising:

a partition section that partitions the tape roll housing section and the cartridge housing section.

3. The housing case according to claim 2, wherein a tape passage portion through which the tape fed from the tape roll toward the ribbon cartridge passes is provided between the first wall section and the partition section.

4. The housing case according to claim 3, wherein the partition section includes a partition body and a partition convex portion protruding from the partition body toward the cartridge housing section, and the partition convex portion engages with a predetermined outer side wall of the ribbon cartridge when the ribbon cartridge is housed in the cartridge housing section.

5. The housing case according to claim 4, wherein the partition body and the partition convex portion are integrally formed by folding a plurality of times a plate-like member.

6. The housing case according to claim 1, wherein in the tape roll housing section, the tape roll and a tape supply unit having a first member on which one end surface of the tape roll is mounted and a second member are housed, the second member comprises a riding-up restraining portion disposed on a side opposite to the first member with respect to the tape roll, the riding-up restraining portion being configured to control the tape so as not to ride up the tape roll;

a tape receiving portion disposed on a side opposite to the tape roll with respect to the first member, the tape receiving portion being configured to receive the tape dropping from the first member; and a coupling portion disposed outside the tape roll in the radial direction, the coupling portion being configured to couple the riding-up restraining portion and the tape receiving portion, and the tape roll housing section comprises a rotation stopping section configured to stop the rotation of the second member when the tape is fed from the tape roll and the tape roll and the first member rotate together.

7. The housing case according to claim 6, wherein the rotation stopping section comes into contact with the coupling portion to prevent the second member from rotating.

8. The housing case according to claim 1, further comprising:

a support section insertion side removal portion removably provided in a second wall section, wherein removing the support section insertion side removal portion forms, in the second wall section, a support section insertion portion through which a rotation support portion configured to rotatably support the tape roll is to be inserted.

9. A tape ribbon set comprising:

a tape roll of a wound tape to be fed to a tape printing device;

a ribbon cartridge having an ink ribbon, the ribbon cartridge and the ink ribbon to be mounted into the tape printing device and the ribbon cartridge being configured to hold the tape fed from the tape roll; and a housing case configured to house the tape roll and the ribbon cartridge, wherein the tape printing device is located outside the housing case, and the housing case comprises:

a tape roll housing section configured to house the tape roll;

a tape discharge side removal portion removably provided in a first wall section, the tape discharge side removal portion to be removed to form a tape discharge in the first wall section through which the tape fed from the tape roll exits the housing case and is fed to the tape printing device; and a cartridge housing section configured to house the ribbon cartridge, the ribbon cartridge and the ink ribbon to be removed out of the housing case for being mounted into the tape printing device.

* * * * *